United States Patent [19]

Titus et al.

[11] Patent Number: 4,691,634

[45] Date of Patent: Sep. 8, 1987

[54] ELECTRO-EXPLOSIVE SAFETY AND ARMING DEVICE

[75] Inventors: John D. Titus, Phoenix; Phillip E. Hall, Scottsdale, both of Ariz.

[73] Assignee: Motorola, Inc., Schaumburg, Ill.

[21] Appl. No.: 875,910

[22] Filed: Jun. 19, 1986

[51] Int. Cl.[4] ..... F42C 15/22; F42C 15/40

[52] U.S. Cl. ..... 102/245; 102/229; 102/231; 102/234; 102/235

[58] Field of Search ..... 102/222, 223, 229, 230, 102/231, 234, 235, 244, 245, 254

[56] References Cited

U.S. PATENT DOCUMENTS

| | | | |
|---|---|---|---|
| 1,806,877 | 5/1931 | Hale | 102/235 |
| 2,737,890 | 3/1956 | Brode | 102/235 X |
| 2,996,990 | 8/1961 | Leaman | 102/223 |
| 3,371,608 | 3/1968 | Webb | 102/245 |
| 3,381,613 | 5/1968 | Webb | 102/245 X |
| 3,724,384 | 4/1973 | Donahue | 102/245 |
| 4,015,533 | 4/1977 | Hermanson | 102/229 |
| 4,145,971 | 3/1979 | Graham et al. | 102/245 X |

*Primary Examiner*—David H. Brown

*Attorney, Agent, or Firm*—Eugene A. Parsons

[57] ABSTRACT

A safety and arming mechanism wherein a sliding member is held in an out-of-line position breaking the fuze train. An actuator releases the sliding member and moves the sliding member, which contains a stab detonator, in-line and towards a firing pin completing the fuze train. Arming and detonating occur at the same time when the fuze train is completed and the stab detonator is impaled on the firing pin.

6 Claims, 1 Drawing Figure

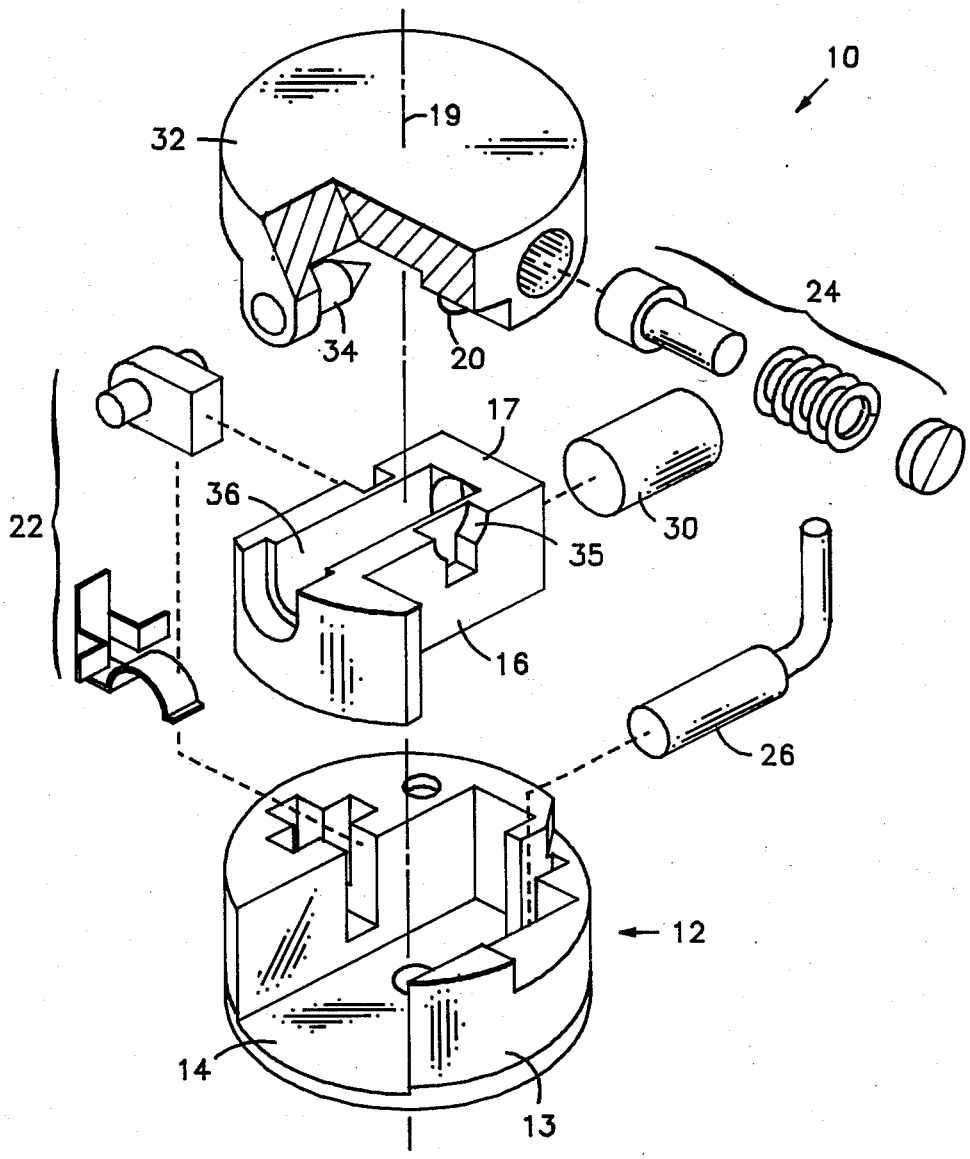
10
19
32
24
34
20
17
22
36
30
35
16
26
12
14
13

ELECTRO-EXPLOSIVE SAFETY AND ARMING DEVICE

BACKGROUND OF THE INVENTION

The present invention pertains to fuzes and specifically to fuzes used in spinning explosive projectiles. Fuzes must remain safe and unarmed until they have traveled a safe distance from the firing device. A prior art fuze is disclosed in U.S. Pat. No. 4,145,971, entitled "Electronic Time Delay Safety and Arming Mechanism", issued Mar. 27, 1979. The fuze disclosed in this patent uses a M100 electronic detonator and related circuitry which is relatively complex and expensive. This electronic detonator is also susceptible to detonation by RF and must be shielded when worked with.

SUMMARY OF THE INVENTION

The present invention is a safety and arming fuze which utilizes a base mounted sliding member. The sliding member is held in an out-of-line position until setback and spin have caused the release of the setback lock and the spin lock respectively. The fuze is then armed by the activation of a miniature piston actuator which moves the sliding member shearing a breakable tab and releasing the sliding member at which time, the slide member, due to the force generated by the spinning of the projectile and the force of the miniature piston actuator, carries a stab detonator to a firing pin fixed on said base. Said stab detonator is impaled on the firing pin and detonates.

It is an object of the present invention to provide a new and improved safety and arming fuze.

It is a further object of the present invention to provide a safety and arming fuze with an improved overhead safety.

It is a further object of the present invention to provide a safety and arming fuze that is more reliable and less expensive.

These and other objects of this invention will become apparent to those skilled in the art upon consideration of the accompanying specification, claims and drawing.

BRIEF DESCRIPTION OF THE ACCOMPANYING DRAWING

The FIGURE is an exploded view illustrating one example of a safety and arming mechanism for a spinning explosive fuze embodying the present invention.

DESCRIPTION OF THE PREFERRED EMBODIMENT

The FIGURE illustrates a safety and arming mechanism (S and A) for a fuze, generally designated 10, on spinning explosive projectiles. Fuze (S and A) 10 includes a base member 12 comprising a base 13 having a generally cylindrical shape with a circular cross section. A channel 14 is formed in base 13 partially along a diameter and through the axis thereof so as to leave a bottom wall and a wall along one end thereof. A sliding member 16 is mounted in channel 14 for sliding movements in response to spinning of the projectile and force exerted by a miniature piston actuator 26. Sliding member 16 moves in a generally radially outward direction from a first or out-of-line position to a second or in-line position. It should be obvious to one skilled in the art that sliding member 16 may be positioned in a number of different ways.

A stab detonator 30 is contained inside a space in the inner end of sliding member 16. Detonator 30 is aligned along the axis of base member 12 when sliding member 16 is in the in-line position. This completes a fuze train (not shown) which runs laterally through sliding member 16 and base 13 to the main charge of the projectile. When in the out-of-line position sliding member 16 holds stab detonator 30 out of the fuze train and in a safe position opposite the open face of channel 14. The center of gravity 17 of the sliding member is inside the axis of rotation 19 in this position thus allowing the force created by the spinning of the projectile to hold sliding member 16 in the out-of-line position. Additionally, sliding member 16 is held in the out-of-line position by a setback lock 22, spin lock 24 and an anti-malassembly tab 20. Tab 20 is attached to a circular cover 32 which fits over base 13 enclosing the fuze for protection. Cover 32 and base 13 cooperate to form base member 12 which, for reasons of ease in manufacture well known to those skilled in the art, is produced in two parts. Tab 20 fits into a slot 35 on sliding member 16 when sliding member 16 is in the out-of-line position. Tab 20 holds sliding member 16 in this position. Tab 20 also serves as a breakable inhibitor to movement of sliding member 16. A firing pin 34 is fixed to the inside of cover 32 and points radially inward. Sliding member 16 is formed with a slot 36 on top, into which firing pin 34 fits when sliding member 16 is in the out-of-line position, and which gives firing pin 34 access to stab detonator 30.

When the projectile is fired setback and spin occur which release setback lock 22 and spin lock 24 respectively. The fuze is then armed by the use of an actuator 26 which is an electro-explosive device. It is mounted on base 13 so as to bear against an outwardly projecting shoulder on sliding member 16. The actuator 26 moves sliding member 16 in a radially outward direction, shearing tab 20 and pushing the center of gravity of sliding member 16 across the axis of rotation of base member 12. The force from the projectile's rotation continues to pull the sliding member in a radially outward direction, now that the center of gravity has been moved across the axis of rotation. As sliding member 16 moves radially outward detonator 30 moves toward firing pin 34 which has access through slot 36. It should be obvious to one skilled in the art, that it would be possible to have other configurations such as the reversal of detonator 30 and firing pin 34 so that detonator 30 is fixed over the axis of base member 12 with firing pin 34 mounted on sliding member 30. When the sliding member 16 reaches the in-line position detonator 30 is impaled on firing pin 34 and actuated.

Cover 32 with firing pin 34 and tab 20 can be put in place only when sliding member 16 is in the out-of-line position. This prevents accidental detonation which might occur if firing pin 34 is put in place when sliding member 16 is in the in-line position, and complies with U.S. Department of Defense standards which require that a safety and arming device must not be capable of being assembled in an in-line position.

Thus an improved safety and arming mechanism for a fuze is disclosed which is extremely safe and reliable. Reliability and safety is a result of the use of a RF insensitive stab detonator which is also much more reliable than the M100 electric detonator. Also since the detonator is out-of-line, and remains in the out-of-line position until the moment the fuze is intended to fire, the overhead safety is improved. The expense is much reduced since the stab detonator is less costly than the previously used M100, and much of the associated connectors and circuitry are not needed.

While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. A safety and arming mechanism for fuzes on spinning explosive projectiles and the like comprising:

a base member adapted to be affixed to the projectile;

a firing pin;

a detonator designed to be activated by contact with said firing pin;

one of said firing pin and said detonator being mounted on said base member;

a sliding member slideably mounted on said base member for movement towards one of said firing pin and said detonator from a first position in which said detonator is safe into a second position in which said detonator is armed;

means holding said sliding member in the out-of-line position;

the other of said detonator and said firing pin being mounted on said sliding member; and actuator means for releasing said sliding member from the first position.

2. A safety and arming mechanism for fuzes on spinning explosive projectiles and the like comprising:

a base member adapted to be affixed to the projectile;

a firing pin mounted on said base member;

a sliding member slideably mounted on said base member for movement towards said firing pin from an out-of-line position to an in-line position, said slideably mounted sliding member having a center of gravity positioned relative to a spin axis of the projectile so that the sliding member is held in the out-of-line position due to the effect of the projectile's spinning action on the center of gravity of said sliding member;

actuator means for moving said sliding member from the out-of-line position; and a stab detonator mounted so as to be properly positioned and come in contact with the firing pin only when the sliding member is in the in-line position.

3. A safety and arming mechanism as claimed in claim 2 wherein the sliding member is mounted to slide in a radially outward direction.

4. A safety and arming mechanism as claimed in claim 2 wherein the actuator means is an electro explosive.

5. A safety and arming mechanism as claimed in claim 2 wherein the slideably mounted sliding member is held in the out-of-line position by a breakable inhibitor.

6. A safety and arming mechanism as claimed in claim 5 wherein the breakable inhibitor is fixed to the base member.

* * * * *